US010032589B2

(12) United States Patent
Bachmaier et al.

(10) Patent No.: US 10,032,589 B2
(45) Date of Patent: Jul. 24, 2018

(54) ACTUATING APPARATUS FOR A VACUUM INTERRUPTER AND DISCONNECTING ARRANGEMENT

(71) Applicant: SIEMENS AKTIENGESELLSCHAFT, Munich (DE)

(72) Inventors: Georg Bachmaier, Munich (DE); Dominik Ergin, Baiersdorf (DE); Andreas Goedecke, Munich (DE); Sylvio Kosse, Erlangen (DE); Andreas Philipp, Winkelhaid (DE)

(73) Assignee: Siemens Aktiengesellschaft, Munich (DE)

( * ) Notice: Subject to any disclaimer, the term of this patent is extended or adjusted under 35 U.S.C. 154(b) by 613 days.

(21) Appl. No.: 14/431,884

(22) PCT Filed: Sep. 11, 2013

(86) PCT No.: PCT/EP2013/068810
§ 371 (c)(1),
(2) Date: Mar. 27, 2015

(87) PCT Pub. No.: WO2014/048747
PCT Pub. Date: Apr. 3, 2014

(65) Prior Publication Data

US 2015/0248984 A1 Sep. 3, 2015

(30) Foreign Application Priority Data

Sep. 27, 2012 (DE) ..... 10 2012 217 583

(51) Int. Cl.
*H01H 9/30* (2006.01)
*H01H 51/27* (2006.01)
(Continued)

(52) U.S. Cl.
CPC ..... *H01H 51/27* (2013.01); *H01H 33/285* (2013.01); *H01H 33/6662* (2013.01);
(Continued)

(58) Field of Classification Search
USPC ..... 361/8–12, 63–69
See application file for complete search history.

(56) References Cited

U.S. PATENT DOCUMENTS 3,534,304 A 10/1970 Robinson et al.
3,751,716 A * 8/1973 Johnson ..... H02H 7/16 361/16

(Continued)

FOREIGN PATENT DOCUMENTS

CN 102013355 A 4/2011
DE 19921173 A1 11/2000

(Continued)

OTHER PUBLICATIONS

Xiongying et al. "Fiber-Controlled Vacuum Interrupter Module Used for Fault Current Interruption" XXIV.th International Symposium on Discharges and Electrical Insulation in Vacuum, Braunschweig, pp. 166-169, 2010.

(Continued)

*Primary Examiner* — Danny Nguyen
(74) *Attorney, Agent, or Firm* — Laurence Greenberg; Werner Stemer; Ralph Locher

(57) ABSTRACT

An actuating device for a vacuum switching tube has a connecting element which can be connected to an electric contact of the vacuum switching tube, an electromagnetic actuating device for displacing the connecting element between a first and a second position, and a retaining yoke, relative to which the connecting element can be displaced and has a first magnetic element. The first magnetic element generates a first and a second magnetic circuit in the retaining yoke. The actuating device further has a ferromag- (Continued)

netic retaining anchor, which is arranged on the connecting element. The retaining anchor is located in the first position of the connecting element in the first magnetic circuit and in the second position of the connecting element in the second magnetic circuit. The connecting element is held in the first and in the second position by a respective magnetic force between the retaining yoke and the retaining anchor.

5 Claims, 5 Drawing Sheets

(51) Int. Cl.

| | |
|---|---|
| ***H01H 33/28*** | (2006.01) |
| ***H01H 33/666*** | (2006.01) |
| ***H01H 50/30*** | (2006.01) |
| ***H01H 50/32*** | (2006.01) |
| ***H01H 50/44*** | (2006.01) |
| ***H01H 50/64*** | (2006.01) |
| *H01H 3/60* | (2006.01) |
| *H01H 47/22* | (2006.01) |

(52) U.S. Cl.
CPC ..... *H01H 50/30* (2013.01); *H01H 50/321* (2013.01); *H01H 50/443* (2013.01); *H01H 50/64* (2013.01); *H01H 3/60* (2013.01); *H01H 47/226* (2013.01)

(56) References Cited

U.S. PATENT DOCUMENTS

| | | | | |
|---|---|---|---|---|
| 2002/0093408 | A1 | 7/2002 | Morita et al. | |
| 2007/0194872 | A1 | 8/2007 | Pfister et al. | |
| 2012/0049995 | A1* | 3/2012 | Murray | H01H 75/04 337/2 |
| 2012/0327549 | A1* | 12/2012 | Chaly | H01H 33/6662 361/160 |

FOREIGN PATENT DOCUMENTS

| | | | |
|---|---|---|---|
| DE | 10011342 | A1 | 9/2001 |
| DE | 201788892 | U | 4/2011 |
| JP | 2002033034 | A | 1/2002 |
| WO | 2007064535 | A1 | 6/2007 |

OTHER PUBLICATIONS

Meyer et al., "A DC Hybrid Circuit Breaker With Ultra-Fast Contact Opening and Integrated Gate-Commutated Thyristors (IGCTs)" IEEE Transaction on Power Delivery, vol. 21, No. 2, pp. 646-651, 2006.

* cited by examiner

ACTUATING APPARATUS FOR A VACUUM INTERRUPTER AND DISCONNECTING ARRANGEMENT

BACKGROUND OF THE INVENTION

Field of the Invention

The present invention relates to an actuating apparatus for a vacuum interrupter. Moreover, the present invention relates to a disconnecting arrangement for disconnecting an electrical circuit.

In mechanical interruption units of medium-voltage and high-voltage switching devices, nowadays spring-energy store drives are usually used as drives for mechanically opening and closing the contact system. This results in a minimum amount of mechanics being required which limits the switching times that can be achieved, for example to a range of between 10 and 50 ms. Such switching times are too low in electrical disconnecting arrangements for HVDC transmission. It is therefore desirable to provide corresponding actuating apparatuses with which the contacts can be disconnected more quickly. In particular, in this case switching times in the single-digit milliseconds range are desirable.

In order to be able to realize such switching times, for example, microgas generators are used. Another possibility consists in providing corresponding explosion drives. Furthermore, electromagnetic drives for the medium-voltage range are proposed. The publication "Fiber-Controlled Vacuum Interrupter Module Used for Fault Current Interruption" by D. Xiongying et al., published at the XXIV.th International Symposium on Discharges and Electrical Insulation in Vacuum, Brunswick, 2010, describes an actuating apparatus for a vacuum interrupter which comprises an electromagnetic actuator, which is designed on the basis of the plunger coil principle.

Furthermore, the article "A DC Hybrid Circuit Breaker With Ultra-Fast Contact Opening and Integrated Gate Commutated Thyristors (IGCTs)" by J.-M. Meyer et al., published in IEEE Transactions on Power Delivery, Vol. 21, No. 2, 2006, describes an actuating apparatus for a vacuum interrupter which comprises an electromagnetic actuator. The holding force during closing is in this case achieved by the magnetization of permanent magnets. For opening, a so-called Thomson actuator is used.

BRIEF SUMMARY OF THE INVENTION

One object of the present invention consists in providing a quicker and more efficient actuating apparatus for opening and closing the contacts of a vacuum interrupter.

This object is achieved by an actuating apparatus and by a disconnecting arrangement having the features of the main patent claims. Advantageous developments of the present invention are specified in the dependent claims.

The actuating apparatus according to the invention for a vacuum interrupter comprises a connecting element, which is connectable to an electrical contact of the vacuum interrupter, an electromagnetic actuating device for moving the connecting element between a first position and a second position, a retaining yoke, relative to which the connecting element is moveable, and which comprises a first magnet element, wherein the first magnet element brings about a first magnetic circuit and a second magnetic circuit in the retaining yoke, and a ferromagnetic retaining armature, which is arranged on the connecting element, wherein the retaining armature is located in the first magnetic circuit in the first position of the connecting element and in the second magnetic circuit in the second position of the connecting element, and wherein the connecting element is held stably in the first position and in the second position by a respective magnetic force between the retaining yoke and the retaining armature.

The actuating apparatus is used for opening and closing the electrical contacts of a vacuum interrupter. The vacuum interrupter generally has a fixed electrical contact and a moveable electrical contact. The actuating apparatus comprises a connecting element, which can be connected to an electrical contact, in particular the moveable electrical contact, of the vacuum interrupter. Furthermore, the actuating apparatus comprises an electromagnetic actuating device, with which the connecting element can be moved between a first position and a second position. Owing to the interaction of the connecting element with the contact of the vacuum interrupter, the contacts of the vacuum interrupter can be open in the first position of the connecting element and closed in the second position of the connecting element. A retaining armature which is formed from a ferromagnetic material is arranged on the connecting element. Furthermore, the actuating apparatus comprises a retaining yoke on which a first magnet element is arranged or in which a first magnet element is integrated.

The retaining yoke is stationary with respect to the connecting element. The connecting element can therefore be moved relative to the retaining yoke. The retaining yoke and the retaining armature are now configured such that a magnetic circuit forms along the retaining armature, the first magnet element and the retaining yoke, both in the first position and in the second position. In other words, a bi stable actuating apparatus is provided, with which the connecting element is held stably in the first and second position as a result of the magnetic forces. Thus, no electrical energy needs to be applied in order to hold the connecting element in the first or second position. Thus, the actuating device can be operated in a manner which is particularly energy-efficient.

Preferably, the electromagnetic actuating device has a second magnet element and a coil element which is moveable relative to the second magnet element and which is connected to the connecting element. In order to be able to move the connecting element to and fro from the first position into the second position, an electromagnetic actuating device is used. The electromagnetic actuating device comprises a coil element, which is surrounded at least regionally by a second magnet element. Owing to the polarity of the electric current flowing through the coil element, a movement of the coil element relative to the second magnet element can be effected. Therefore, the connecting element can be moved in a simple manner. In this case, the second magnet element can be formed whilst dispensing with any ferromagnetic field guidance. In particular, the second magnet element can be formed only by permanent magnets. In this case, the second magnet element can also be designed in the manner of a so-called Halbach array. In this case, the second magnet element can comprise a plurality of permanent magnets, whose direction of magnetization is tilted toward one another in each case through 90° along the direction of extent. Thus, the magnetic flux in the region of the second magnet element which at least regionally surrounds the coil element can be intensified. Thus, particularly efficient servo drive can be provided for moving the connecting element.

In a further embodiment, the first and second magnet elements are formed integrally as a magnet apparatus. In other words, the second magnet element of the electromagnetic actuating device can be combined with the first magnet element of the retaining yoke. This enables, for example, the use of a single permanent magnet in the actuating apparatus.

In a further configuration, the retaining armature and the coil element are formed integrally as a coil apparatus. The retaining armature and the coil element can be combined in a common, integrated coil apparatus or coil assembly. As a result, savings can be made on the installation space and the weight of the actuating apparatus can be reduced.

Moreover, in accordance with the invention, a disconnecting arrangement for disconnecting an electrical circuit is provided. The disconnecting arrangement comprises at least one vacuum interrupter, which has two electrical contacts, and at least one of the above-described actuating apparatuses, wherein the connecting element of the at least one actuating apparatus is connected to one of the contacts of the at least one vacuum interrupter in such a way that the contacts are open in the first position of the connecting element and are closed in the second position of the connecting element.

The disconnecting arrangement can be used for disconnecting an electrical connection, in particular a high-voltage connection. The disconnecting arrangement comprises at least one interrupter, which is commercially available, for example. Such a vacuum interrupter can have, for example, a rated voltage of 24 kW AC, a rated operating current of 2 kA and a moving contact piece with a mass of 0.9 kg. The connecting element of the actuating apparatus is directly connected to the moveable contact of the vacuum interrupter. A direct drive for the vacuum interrupter can thus be provided, and therefore no additional component parts which would mean additional moving mass are required.

In one embodiment, the disconnecting arrangement comprises a control apparatus for controlling an electric current flowing through the coil element of the at least one actuating apparatus, said control apparatus being designed to reduce the electric current flowing through the coil element if the connecting element draws close to the first or second position. The electric current flowing through the coil element can be adapted using the control apparatus of the disconnecting arrangement. Therefore, the movement of the connecting element, which is fixedly connected mechanically to the coil element, can be controlled in a simple manner. Owing to the simple design of the electromagnetic actuating device, particularly fast switching times can be achieved. Thus, the electromagnetic actuating device can be actuated in such a way that, via the movement of the connecting element, the electrical contacts of the vacuum interrupter cover a predetermined distance, for example 4 mm, in a formative time period, for example 2 ms.

If the connecting element is intended to be moved from one of the positions into the other, the current intensity in the coil element can first be increased. As a result, the connecting element can be accelerated. If the connecting element approaches the first or second position, the current intensity in the coil element can be reduced again. As a result, the movement velocity of the connecting element is reduced. In the process, provision can also be made for the polarity of the electric current flowing through the coil element to be reversed. Therefore, a braking force directed in the opposite direction to the movement velocities of the connecting element is generated. It is thus possible to prevent the retaining armature from hitting the retaining yoke in one of the positions and therefore to prevent the retaining yoke or the retaining armature from being damaged or being subject to wear during continuous operation.

Preferably, the control device comprises a bridge circuit comprising semiconductor switches. The bridge circuit can in particular be in the form of a full bridge or an H bridge. MOSFETs or IGBTs can be used as semiconductor switches. Therefore, energy-efficient actuation of the coil element can be achieved.

In a further configuration, the disconnecting arrangement has a damping element for reducing a movement velocity of the connecting element. In addition to the electrical actuation, mechanical or hydraulic dampers can be provided in the disconnecting arrangement, with which dampers the movement velocity of the connecting element is reduced within a respective region of the first or second position of the connecting element. In particular, a mechanical or hydraulic damper which converts the kinetic energy of the connecting element substantially into friction heat can be used as damping element. Thus, the movement of the connecting element can be braked in a simple manner.

In a further configuration, the disconnecting arrangement has an emergency switching element for closing the contacts of the vacuum interrupter. In the case of failure of switching, i.e. when the vacuum interrupter cannot be closed owing to a defect in the electromagnetic actuating device, emergency actuation can be implemented. The emergency switching element used for this can be formed either by a pyro element or by a tensioned spring, which is unlatched. Thus, the vacuum interrupter can be closed again in a simple manner in the event of an emergency.

In one embodiment, the disconnecting arrangement comprises two actuating apparatuses and two vacuum interrupters, wherein the control device is designed to control the electric current flowing through the coil element of the first of the two actuating apparatuses and the electric current flowing through the coil element of the second of the two actuating apparatuses in a manner temporally offset with respect to one another. For example, the electromagnetic actuating devices of the two actuating apparatuses can be switched in opposition. Owing to the impulse neutrality towards the outside, good mechanical stability can be achieved.

BRIEF DESCRIPTION OF THE SEVERAL VIEWS OF THE DRAWING

The invention will now be explained in more detail with reference to the attached drawings, in which.

DESCRIPTION OF THE INVENTION

The exemplary embodiments described in more detail below represent preferred embodiments of the present invention.

Figure 1:
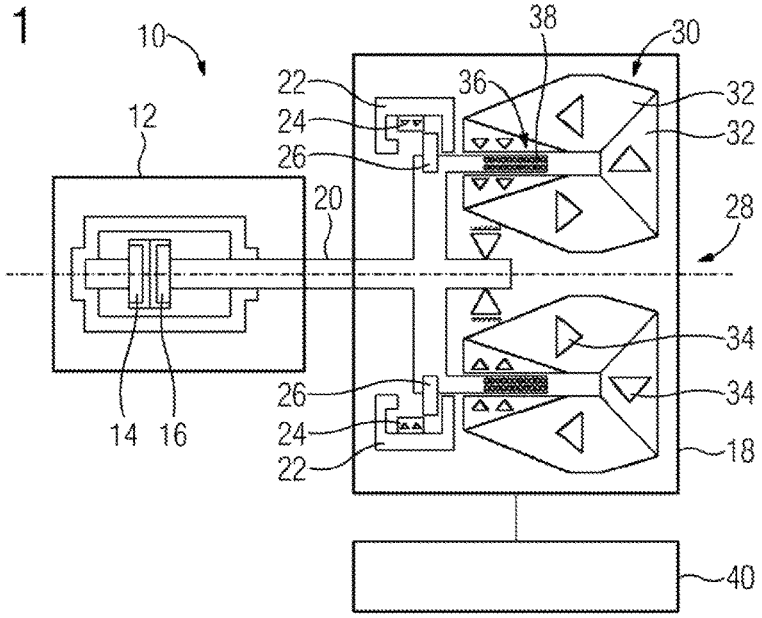
FIG. 1 shows a disconnecting arrangement in a schematic illustration.

FIG. 1 shows a disconnecting arrangement 10 in a schematic illustration. The disconnecting arrangement 10 comprises a vacuum interrupter 12. The vacuum interrupter 12 serves to disconnect an electrical connecting line, in particular a high-voltage electrical line. The vacuum interrupter 12 comprises a stationary contact 14 and a moveable contact 16. Furthermore, the disconnecting arrangement 10 comprises an actuating apparatus 18. The actuating apparatus 18 comprises a connecting element 20, which is mechanically connected to the moveable contact 16 and the vacuum interrupter 12. Owing to a movement of the connecting element 20, the moveable contact 16 can be moved, i.e. the vacuum interrupter 12 can be opened or closed.

Furthermore, the actuating apparatus 18 comprises two retaining yokes 22. Each retaining yoke 22 is arranged fixedly on the connecting element 20. A first magnet element 24 is arranged on the retaining yoke 22. The first magnet element 24 can be formed by a permanent magnet. The first magnet element 24 can also be integrated in the respective retaining yoke 22. In addition, the actuating apparatus 18 comprises a retaining armature 26, which is mechanically connected to the connecting element 20. Along the retaining armature 26, the first magnet element 24 and the retaining yoke, a first closed magnetic circuit is formed in a first position (illustrated here) of the connecting element 20. In the present first position, the electrical contacts 14, 16 of the vacuum interrupter 12 are open.

In order to close the contacts 14, 16 of the vacuum interrupter 12, the connecting element 20 needs to be moved from the first position into a second position. For this purpose, the electromagnetic actuating device 28 is used. The electromagnetic actuating device 28 comprises a second magnet element 30. The second magnet element 30 comprises a plurality of permanent magnets 32. In the present case, the second magnet element 30 comprises two arrangements of permanent magnets 32 which are physically separated from one another. The magnetization direction of the respective permanent magnets is identified by the arrows 34. Furthermore, the electromechanical actuating device 28 comprises a coil element 36. The coil element 36 is mechanically connected to the connecting element 20. The permanent magnets 32 are in this case arranged in such a way that they at least regionally surround the coil element 36. The coil element 36 has corresponding windings 38, which extend perpendicular to the magnetization direction of the permanent magnets 32 in the region in which they are surrounded by the permanent magnet 32.

Furthermore, the disconnecting arrangement 10 comprises a control device 40. The electric current in the coil element 36 can be controlled by the control device 40. If an electric current of a first polarity is applied to the coil element 36, the connecting element 20 is moved from the first position into the second position. If a current intensity of a second polarity is applied to the coil element 36, the connecting element is moved back to the first position from the second position.

Figure 2:
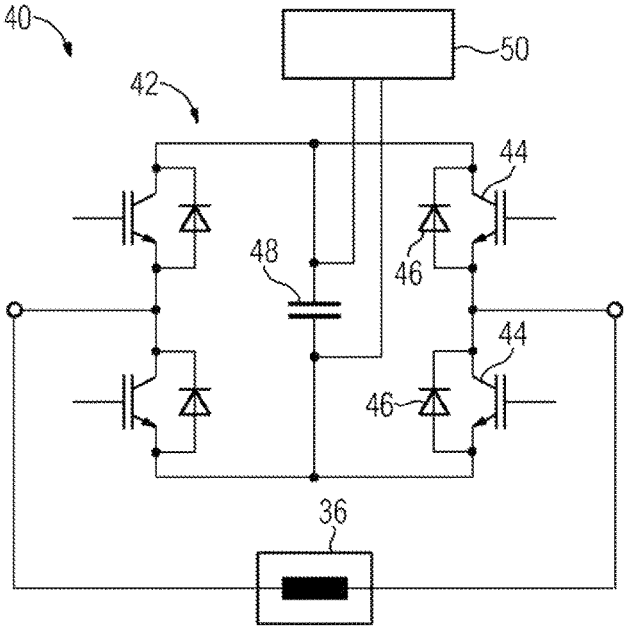
FIG. 2 shows a control device of the disconnecting arrangement.

FIG. 2 shows a circuit arrangement of the control device 40. The control device 40 comprises a bridge circuit 42 in the form of an H bridge or full bridge. The bridge circuit 42 comprises the semiconductor switching elements, which are in the form of transistors or IGBTs, for example, and which each comprise an inversely switched diode 46. Furthermore, the bridge circuit 42 comprises a capacitor 48, which is fed via a precharging device 50. The electric current through the coil element 36 can be adapted in a simple manner by the bridge circuit 42.

Figure 3:
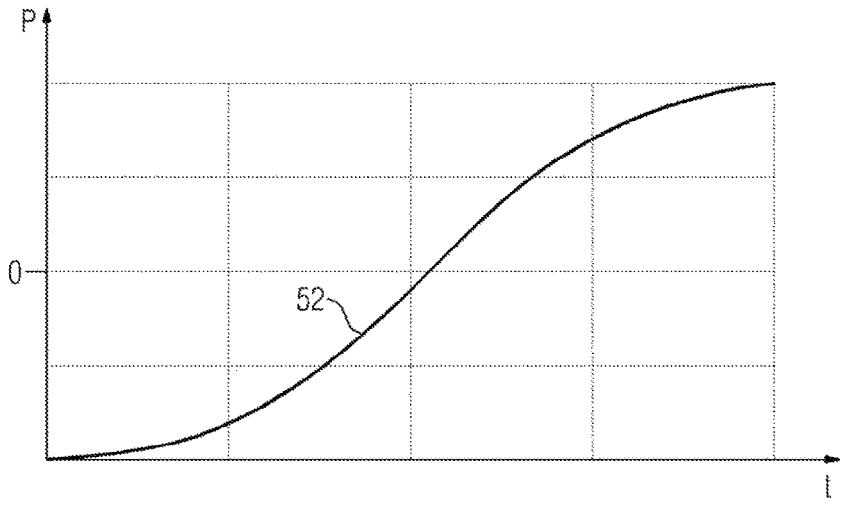
FIG. 3 shows the time profile of a position of a contact of a vacuum interrupter of the disconnecting arrangement.
Figure 4:
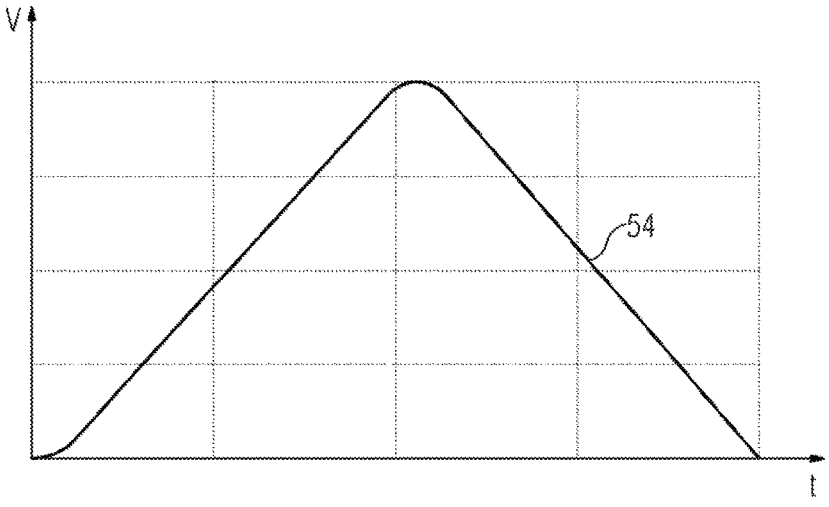
FIG. 4 shows a time profile of a velocity of the contact.
Figure 5:
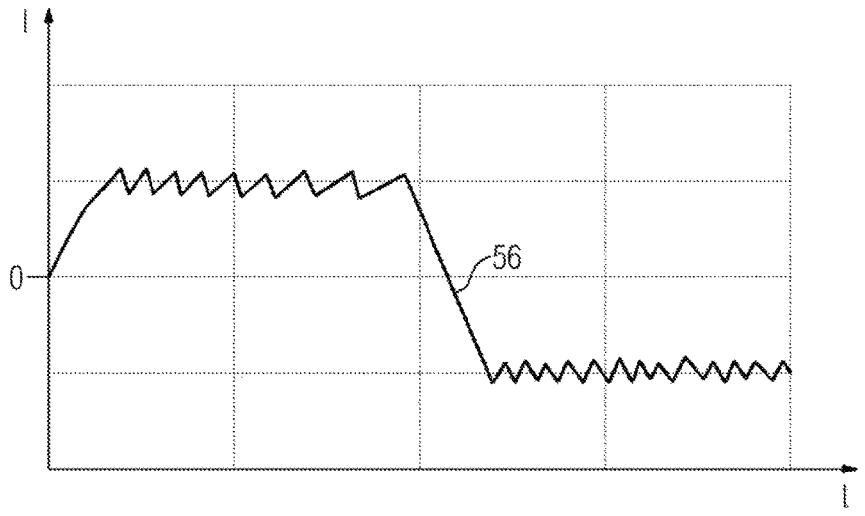
FIG. 5 shows a time profile of the current intensity through a coil element of the disconnecting arrangement.
Figure 6:
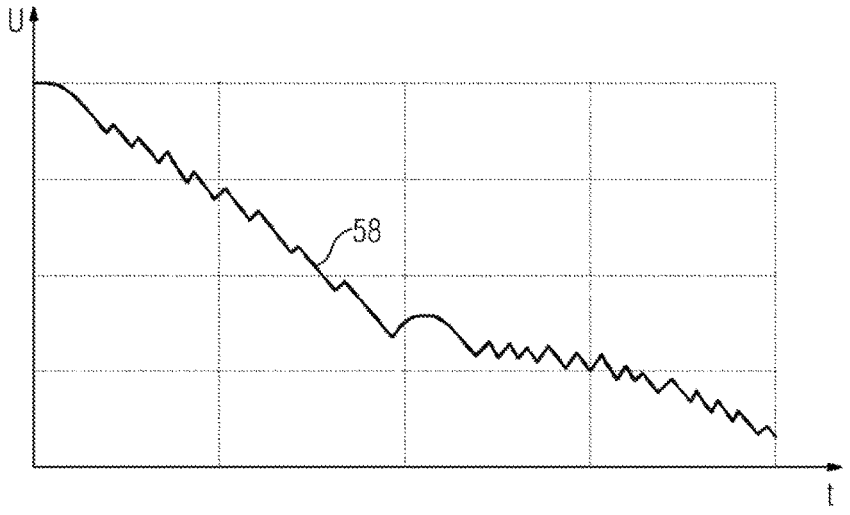
FIG. 6 shows a time profile of the electric voltage at a capacitor of the control device.

FIG. 3 shows the profile 52 of the position p of the moveable contact element 16 as a function of time t. During operation of the actuating apparatus 18, the connecting element 20 is intended to be actuated in such a way that the moveable contact 16 is initially accelerated into the second position starting from the first position. Prior to the second position being reached, the velocity v of the second contact element needs to be reduced. This is represented in the profile 54 in FIG. 4. It is thus possible to prevent the connecting element 20 or the retaining armature 26 from hitting the retaining yoke 22 in the second position. For this purpose, the electric current flowing through the coil element 36 is initially increased. Then, the polarity of the electric current is reversed, as a result of which a braking force which is directed opposite the movement velocity v of the moveable contact 16 is generated. The time profile of the electric current intensity I through the coil element is shown by the profile 56 in FIG. 5. FIG. 6 shows, in the profile 58, the electric voltage U at the capacitor 48.

Figure 7:
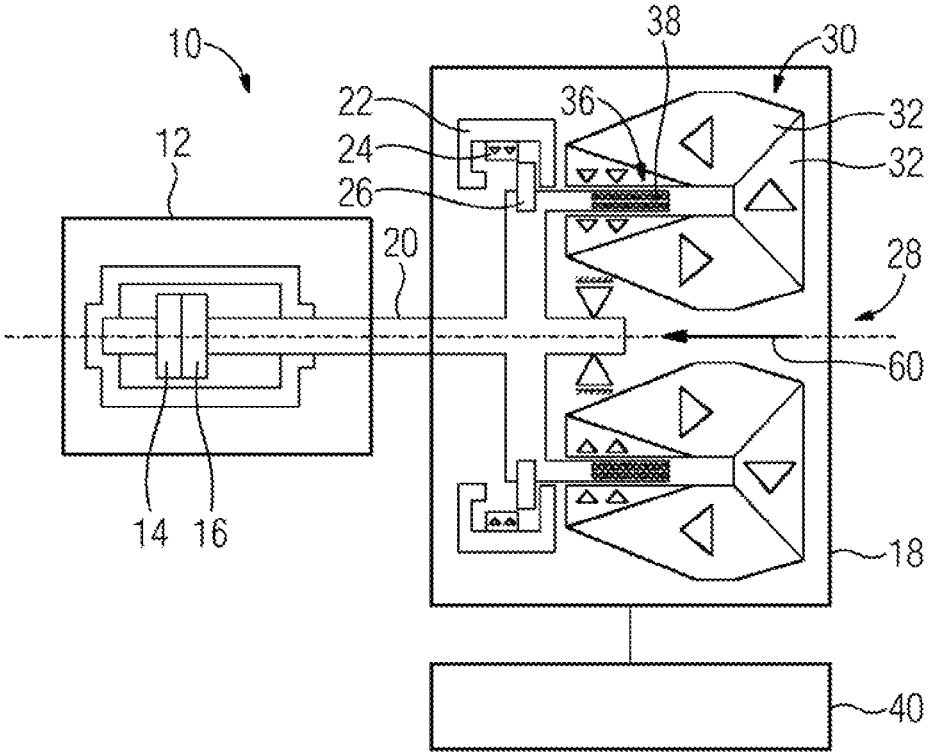
FIG. 7 shows a disconnecting arrangement in a second embodiment.

FIG. 7 shows the disconnecting arrangement 10 in a further embodiment. The disconnecting arrangement 10 comprises an emergency switching element 60. The emergency switching element 60 can comprise a pyro element or a tensioned spring. In the event of an emergency, i.e. in the case of a failure of the electromagnetic actuating device 28, the connecting element 20 can be moved from the first position into the second position with the aid of the emergency switching device 60. Thus, the electrical contacts 14, 16 can be closed.

Figure 8:
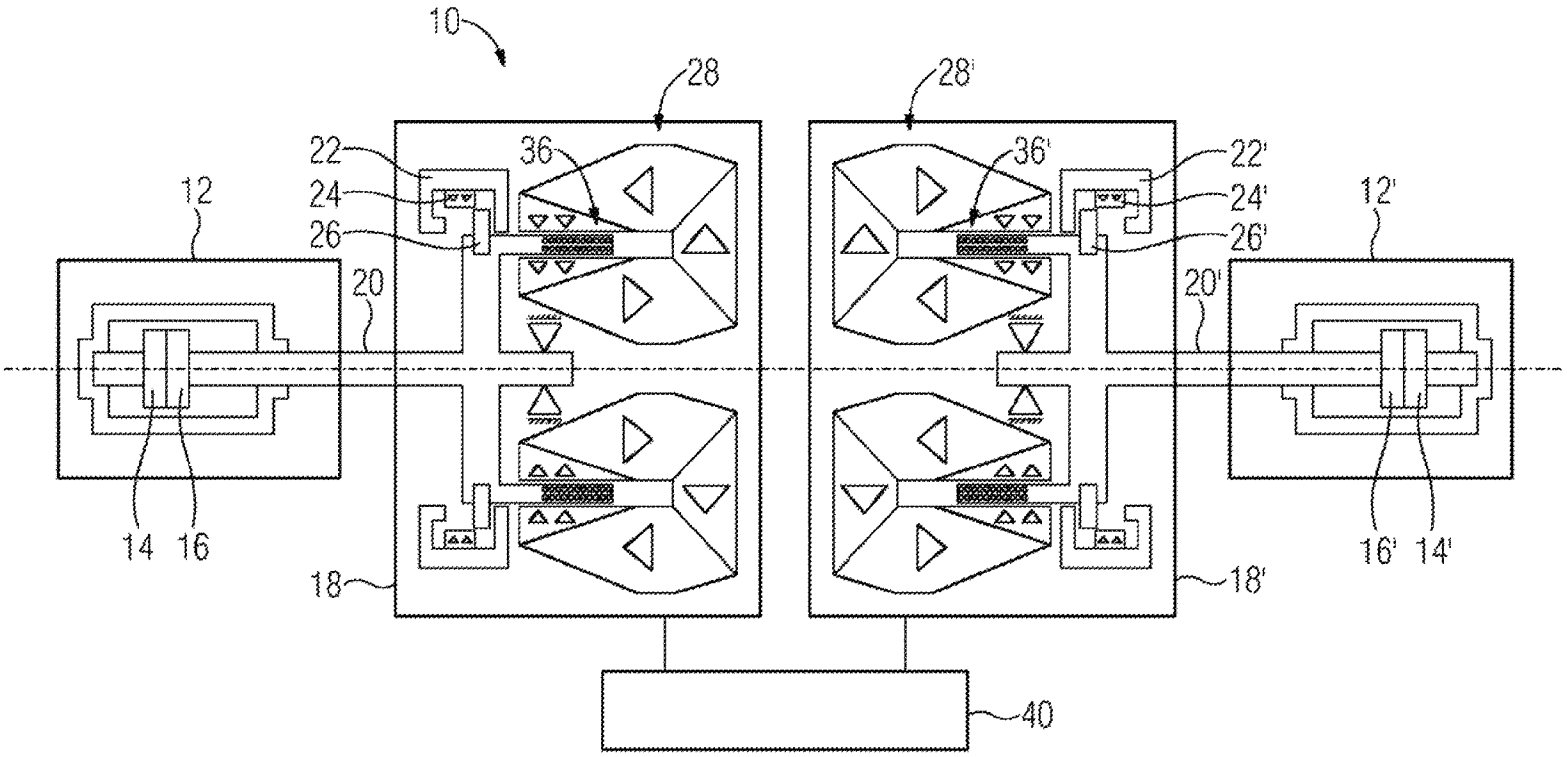
FIG. 8 shows a disconnecting arrangement in a third embodiment.

Finally, FIG. 8 shows a further embodiment of a disconnecting arrangement 10. The disconnecting arrangement 10 illustrated here comprises two vacuum interrupters 12, 12', which are each connected to an actuating apparatus 18 and 18', as explained previously in connection with FIG. 1. In the present case, only one control device 40 is used, with which both the coil element 36 and the coil element 36' of the second actuating apparatus 18' can be actuated. In this case, by virtue of the actuation of the coil elements 36, 36' of the control apparatus 40, the electromagnetic actuating devices 28, 28' of the first actuating apparatus 18 and the second actuating apparatus 18' can be switched in opposition. Owing to the impulse neutrality, good mechanical stability can be achieved.

The invention claimed is:

1. A disconnecting configuration for disconnecting an electrical circuit, the disconnecting configuration comprising:

at least one vacuum interrupter having two electrical contacts;

a controller; and at least one actuating apparatus, said actuating apparatus containing:

a connecting element;

an electromagnetic actuating device for moving said connecting element between a first position and a second position;

a retaining yoke, relative to said retaining yoke said connecting element is moveable, said retaining yoke having a first magnet element, said first magnet element bringing about a first magnetic circuit and a second magnetic circuit in said retaining yoke;

a ferromagnetic retaining armature disposed on said connecting element, said ferromagnetic retaining armature disposed in said first magnetic circuit in the first position of said connecting element and in said second magnetic circuit in the second position of said connecting element;

said connecting element is held stably in the first position and in the second position by a respective magnetic force between said retaining yoke and said retaining armature; and said connecting element of said at least one actuating apparatus is connected to one of said contacts of said at least one vacuum interrupter in such a way that said contacts are open in the first position of said connecting element and are closed in the second position of said connecting element;

said controller for controlling an electric current flowing through said coil element of said at least one actuating apparatus, said controller configured for reducing the electric current flowing through said coil element if said connecting element draws close to the first or second position.

2. The disconnecting configuration according to claim 1, wherein said controller has a bridge circuit with semiconductor switches.

3. The disconnecting configuration according to claim 1, further comprising a damping element for reducing a movement velocity of said connecting element.

4. The disconnecting configuration according to claim 1, further comprising an emergency switching element for closing said contacts of said vacuum interrupter.

5. The disconnecting configuration according to claim 1, wherein:

said at least one actuating apparatus is one of two actuating apparatuses;

said at least one vacuum interrupter is one of two vacuum interrupters; and said controller is configured to control the electric current flowing through said coil element of a first one of said two actuating apparatuses and the electric current flowing through said coil element of a second one of said two actuating apparatuses in a manner temporally offset with respect to one another.

* * * * *